US009366518B2

(12) United States Patent
Guyon et al.

(10) Patent No.: US 9,366,518 B2
(45) Date of Patent: Jun. 14, 2016

(54) SYSTEM FOR TRIGGERING A PLURALITY OF ELECTRONIC DETONATOR ASSEMBLIES

(71) Applicants: Franck Guyon, Auxerre (FR); Samir Bouamar, Bassou (FR)

(72) Inventors: Franck Guyon, Auxerre (FR); Samir Bouamar, Bassou (FR)

(73) Assignee: DAVEY BICKFORD, Hery (FR)

( * ) Notice: Subject to any disclaimer, the term of this patent is extended or adjusted under 35 U.S.C. 154(b) by 0 days.

(21) Appl. No.: 14/366,420

(22) PCT Filed: Dec. 12, 2012

(86) PCT No.: PCT/FR2012/052899

§ 371 (c)(1),
(2) Date: Jun. 18, 2014

(87) PCT Pub. No.: WO2013/093300

PCT Pub. Date: Jun. 27, 2013

(65) Prior Publication Data

US 2015/0007740 A1 Jan. 8, 2015

(30) Foreign Application Priority Data

Dec. 19, 2011 (FR) ..... 11 61953

(51) Int. Cl.
*F42D 1/05* (2006.01)
*F42D 1/06* (2006.01)
*F42D 1/055* (2006.01)

(52) U.S. Cl.
CPC *F42D 1/05* (2013.01); *F42D 1/055* (2013.01); *F42D 1/06* (2013.01)

(58) Field of Classification Search
CPC ..... F42D 1/05; F42D 1/055; F42D 1/06
USPC ..... 102/215, 217
See application file for complete search history.

(56) References Cited

U.S. PATENT DOCUMENTS 4,724,766 A * 2/1988 LaBudde ..... F42B 12/58 102/206
5,214,236 A * 5/1993 Murphy ..... F42D 1/05 102/215
5,539,636 A * 7/1996 Marsh ..... F42D 1/055 700/286
6,173,651 B1 1/2001 Pathe et al.
(Continued)

FOREIGN PATENT DOCUMENTS

WO 97/45696 A1 12/1997
WO 01/67031 A1 9/2001
(Continued)

OTHER PUBLICATIONS

International Search Report, dated Apr. 10, 2013, from corresponding PCT application.

*Primary Examiner* — Bret Hayes
(74) *Attorney, Agent, or Firm* — Young & Thompson

(57) ABSTRACT

A system for triggering includes a plurality of electronic detonator assemblies (11), where each electronic detonator assembly (11) is connected to a leading wire (12) linked to a local fire control unit (12). At least one of the local fire control units (13S) includes an electronic synchronization module (14) connected to a leading wire linked to a master local fire control unit (13M), which is one of the local fire control units (13). The system is suitable for use in triggering a plurality of electronic detonator assemblies (11) according to a single blasting pattern.

14 Claims, 2 Drawing Sheets

(56) References Cited

U.S. PATENT DOCUMENTS

| | | | | |
|---|---|---|---|---|
| 7,975,613 | B2 * | 7/2011 | Labuschagne et al. | 102/217 |
| 2003/0136289 | A1 * | 7/2003 | Hallin et al. | 102/200 |
| 2005/0115437 | A1 * | 6/2005 | Jennings, III | F42D 1/055 102/206 |
| 2006/0130693 | A1 * | 6/2006 | Teowee | 102/215 |
| 2009/0145321 | A1 * | 6/2009 | Russell | 102/215 |
| 2010/0005994 | A1 * | 1/2010 | Jacobson et al. | 102/215 |
| 2011/0265677 | A1 * | 11/2011 | Hummel et al. | 102/215 |
| 2012/0174809 | A1 * | 7/2012 | Stewart | F42C 11/06 102/215 |

FOREIGN PATENT DOCUMENTS

| | | | |
|---|---|---|---|
| WO | 02/31431 | A1 | 4/2002 |
| WO | 2006/094358 | A1 | 9/2006 |
| WO | 2007/143759 | A1 | 12/2007 |
| WO | 2011/140571 | A1 | 11/2011 |

* cited by examiner

SYSTEM FOR TRIGGERING A PLURALITY OF ELECTRONIC DETONATOR ASSEMBLIES

The present invention relates to an ignition system for several sets of electronic detonators.

Generally, the present invention relates to the field of working with explosives, utilizing a very large number of electronic detonators triggered in a precise time sequence, also called a blasting pattern.

DESCRIPTION OF THE RELATED ART

Such an ignition system for several sets of electronic detonators is in particular described in the document WO 97/45696.

Generally, in such an ignition system, a set of electronic detonators is connected to a blasting line connected to a local blast control unit.

This local blast control unit is designed so as to allow the ignition of the electronic detonators connected to the blasting line, from an item of ignition data sent by radio by a remote blast control unit.

The remote blast control unit therefore controls the local blast control unit both during test phases for verifying the correct operation of each electronic detonator and for the actual ignition phase of these electronic detonators.

In such an ignition system architecture, and taking into account the losses created by the different linking and connecting cables and the possible current losses, a limited number of electronic detonators, for example of the order of 1,500, can be connected to a single blasting line linked to a local blast control unit.

When a greater number of electronic detonators is required in the ignition system, several local blast control units can be utilized in parallel and controlled by radio by the remote blast control unit.

However, it is then necessary to send separate ignition orders to each remote blast control unit.

Such system is in particular described in the document FR 2 955 933.

However, even by synchronizing the sending of ignition orders to the different local blast control units at the remote blast control unit, the different propagation times of the signals to these local blast control units necessarily lead to a loss of synchronism in the ignition orders.

Such a system is not suitable for controlling all of the electronic detonators if the latter constitute a single blasting pattern, due to the loss of synchronism in the ignition orders.

BRIEF SUMMARY OF THE INVENTION

A purpose of the present invention is to overcome at least one of the aforementioned drawbacks and to propose an ignition system for several sets of electronic detonators based on triggering a blast controlled by a remote blast control unit.

To this end, the present invention relates to an ignition system for several sets of electronic detonators, each set of electronic detonators being connected to a blasting line linked to a local blast control unit.

According to the invention, at least one of the local blast control units comprises an electronic synchronization module connected to a blasting line linked to a master local blast control unit chosen from the local blast control units.

Thus, one or more local blast control units are linked by an electronic synchronization module to a blasting line associated with a master local blast control unit.

Such a layout makes it possible to trigger ignition of all the electronic detonators of the system at the remote blast control unit.

The electronic synchronization module allows this ignition to be carried out in a synchronized manner for the different sets of electronic detonators, according to a single blasting pattern.

According to a feature of the invention, several local blast control units respectively comprise an electronic synchronization module connected to the blasting line of the master local blast control unit.

As indicated previously, the use of several local blast control units connected by an electronic synchronization module to the master local blast control unit makes it possible to increase the number of electronic detonators in a single blasting pattern.

According to an embodiment of the invention, the electronic synchronization module is connected to an input of a microcontroller of at least one of the local blast control units, the ignition of the electronic synchronization module driving an ignition order via the microcontroller of a set of electronic detonators connected to the blasting line linked to this local blast control unit.

In a practical embodiment of the invention, the electronic synchronization module comprises an electronic ignition module suitable for generating an electrical pulse at the input of the microcontroller.

In order to authorize the ignition of several sets of electronic detonators according to an overall blasting pattern, the electronic detonators comprise storage means of a programmable ignition delay, the ignition delays of the electronic detonators of several sets being programmed according to an overall blasting pattern.

In practice, the programmed ignition delay for the electronic detonators connected to the blasting line linked to the master local control unit is incremented by a compensation value equal to a propagation time of the ignition order between the master local blast control unit and the input of the microcontroller of at least one of the local blast control units.

Programming the ignition delays therefore takes into account the propagation times of the ignition order between the master local blast control unit and the other local blast control units.

BRIEF DESCRIPTION OF THE DRAWINGS

Yet further features and advantages of the invention will become apparent from the following description.

In the attached drawings, given as non-limitative examples.

DETAILED DESCRIPTION OF THE PREFERRED EMBODIMENTS

Figure 1:
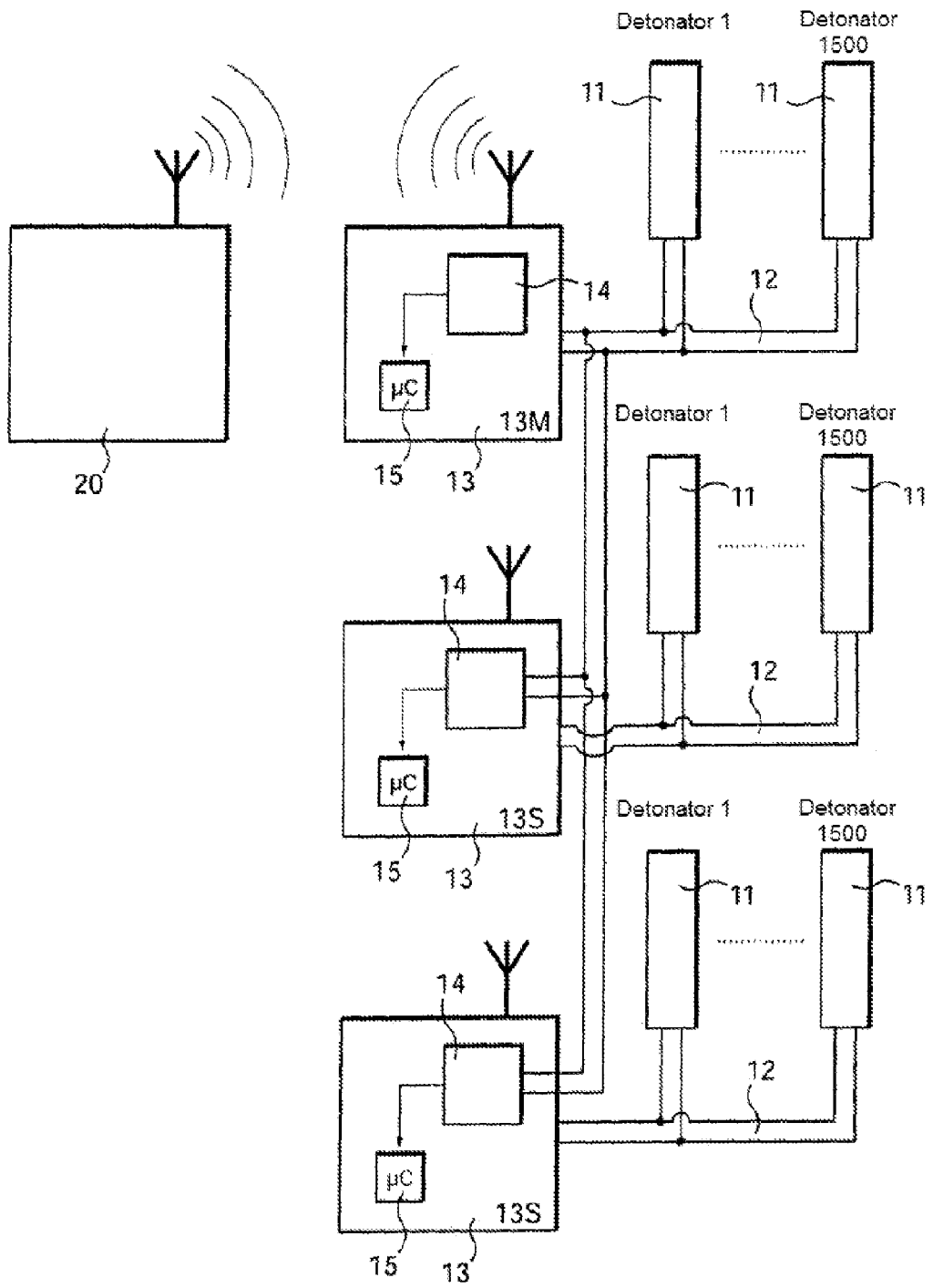
FIG. 1 is a diagram showing an ignition system for several sets of electronic detonators according to an embodiment of the invention.

An example of an ignition system constituted by several sets of electronic detonators 11 is shown in FIG. 1.

These electronic detonators 11 can for example be similar to those described in document WO 97/45696.

This system comprises any number of electronic detonators 11 connected to a blasting line 12 linked to a local blast control unit 13.

The electronic detonators 11 can be used in significant number in a parallel layout on a single blasting line 12, for example over 1,000.

In the embodiment example, 1,500 electronic detonators are mounted in parallel on a single blasting line 12.

The electronic detonators 11 are for example equipped with a ROM storing a unique identifier of the detonator, for example, a 24-bit identifier.

These electronic detonators 11 are suitable for dialogue with the local blast control unit 13, which can transmit orders to, and receive data from them.

Each electronic detonator 11 comprises an electronic ignition module and a detonating charge.

The electronic ignition module allows in particular the transfer of data between the electronic detonator 11 and the local blast control unit 13, or also a programming console used in standard fashion in this type of system for programming the blasting sequences also called "blasting pattern".

The electronic ignition module of each electronic detonator 11 also comprises storage means for a programmable ignition delay according to the blasting pattern chosen.

Figure 2:
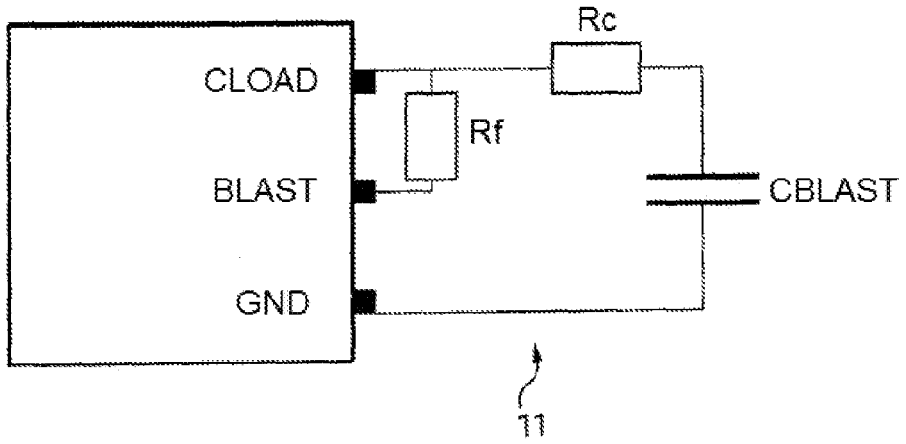
FIG. 2 is a diagram showing an electronic ignition module of an electronic detonator.

An example of an electronic ignition module of an electronic detonator 11 is shown in FIG. 2.

In particular, this electronic ignition module comprises a blasting capacitor CBLAST capable of storing the energy required for ignition of the electronic detonator 11.

The blasting capacitor CBLAST is mounted in series with a load resistor Rc and connected to an integrated control circuit, between a load input CLOAD and the ground GND.

A heating resistor Rf is mounted in parallel with the blasting capacitor CBLAST, and more precisely between the load input CLOAD and a blasting control input CBLAST of the integrated control circuit.

In normal operation, the electrical energy stored in the blasting capacitor CBLAST is released through the heating resistor Rf.

The rise in temperature of the heating resistor Rf associated with the electronic detonator 11 initiates the ignition of the pyrotechnic chain associated with this electronic detonator 11.

Each local blast control unit 13 also comprises an electronic synchronization module 14.

The electronic synchronization module 14 is connected to an input of a microcontroller 15 of each local blast control unit 13.

Figure 3:
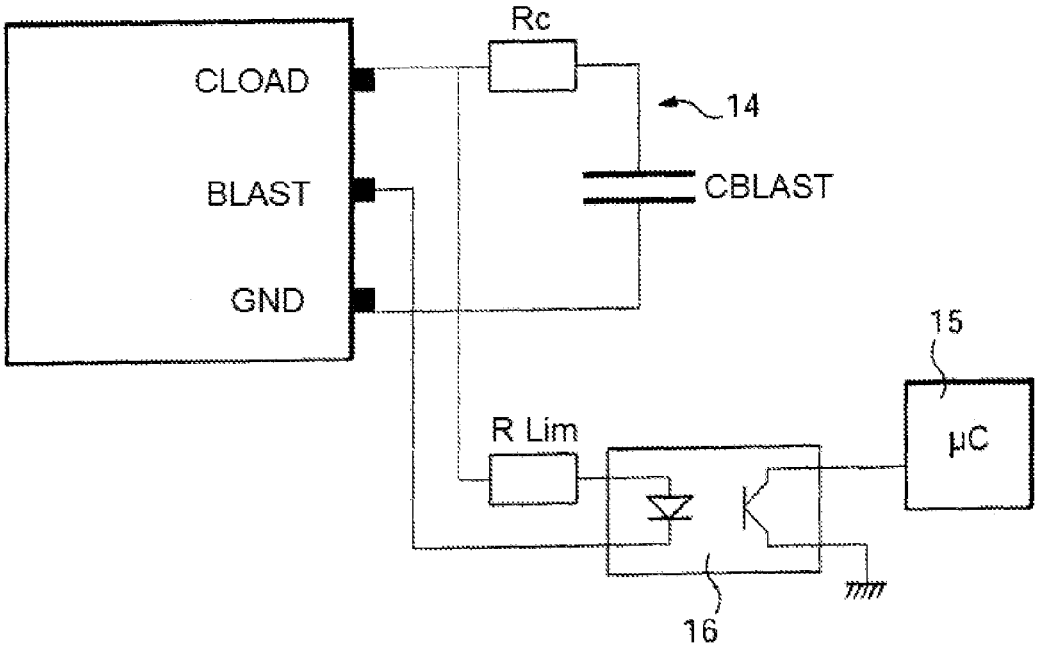
FIG. 3 is a diagram showing an electronic ignition module of an electronic synchronization module connected to the input of a microcontroller.

FIG. 3 shows an embodiment example of the electronic synchronization module 14 connected to an input of a microcontroller 15.

The electronic synchronization module 14 incorporates an electronic ignition module the structure of which corresponds to a variation of the design of the electronic ignition module of an electronic detonator 11 as described previously with reference to FIG. 2.

Thus, the elements in common with this electronic detonator 11 have the same references and do not need to be described again in detail here.

In principle, the electronic synchronization module 14 is distinguished from the electronic detonator 11 by the absence of the heating resistor Rf, which is replaced by a coupling circuit with an optocoupler.

Thus, in parallel with the blasting capacitor CBLAST a circuit is installed constituted by a resistance RLim associated with an optocoupler 16.

Thus, the electrical energy stored in the blasting capacitor CBLAST is released in order to trigger the optocoupler 16.

The ignition of this electronic synchronization module 14 then generates an electrical pulse at the input of the microcontroller 15 installed at the output of the optocoupler 16.

It should be noted that the electronic synchronization module 14 does not comprise a detonating charge and can be used as many times as necessary.

Thus, at each local blast control unit 13, the ignition of the electronic synchronization module 14 drives an ignition order using the microcontroller 15 of the set of electronic detonators 11 connected to the blasting line 12 linked to this local blast control unit 13.

The ignition of the electronic detonators 11 thus linked to the blasting line 12 can be triggered in accordance with the programmable ignition delay stored in the memory associated with each electronic detonator 11 according to a predefined blasting pattern.

In order to carry out the total synchronization of the ignition of all of the electronic detonators 11 linked to each local blast control unit 13 of the system, a master local blast control unit, identified hereafter by the reference 13M, is chosen from the local blast control units 13.

The other local blast control units 13 of the system are then considered as slave local blast control units identified hereafter by the reference 13S.

In the embodiment shown in FIG. 1, the ignition system thus comprises two slave local blast control units 13S.

In the ignition system, the master local blast control unit 13M and the slave local blast control units are connected by radio to a remote blast control unit 20, also called ignition console 20.

In order to carry out the synchronization of the ignition of the set of electronic detonators 11, the electronic synchronization module 14 of each slave local blast control unit 13S is connected to the blasting line 12 linked to the master local blast control unit 13M.

It should be noted that the electronic synchronization module 14 of the master local blast control unit 13M is then not used.

As all the local blast control units 13 comprise an electronic synchronization module 14, it is possible to assign the master role to any one of these local blast control units 13 at the time the system is connected.

The electronic synchronization module 14 of the slave local blast control units 13S is seen by the master local blast control unit 13M as an electronic detonator 11 of the blasting line 12 to which it is associated therewith, and thus incorporated into its blasting pattern.

Thus, when a blast is triggered at the remote blast control unit 20, directed to the master local blast control unit 13M, the latter drives the ignition of the set of detonators 11 and of the electronic synchronization modules 14 linked to the blasting line 12 associated with the master local blast control unit 13M via its microcontroller 15.

Thus, as well as triggering the electronic detonators 11 associated with the blasting line 12 linked to the master local blast control unit 13M, the electronic synchronization modules 14 of the slave local blast control units 13S are also powered so as to drive the ignition of the associated electronic detonators 11 at each slave local blast control unit 13S.

Thus, from the triggering of a single blast originating from the remote blast control unit 20, it is possible to trigger in a synchronized manner all of the electronic detonators 11 of the system.

In order to do this, the ignition delays stored in each electronic detonator 11 of the different sets, associated with each local blast control unit 13 are programmed according to an overall blasting pattern.

In particular, the programmed ignition delay for the electronic detonators 11 connected to a blasting line 12 linked to the master local blast control unit 13M is incremented by a compensation value equal to the propagation time of the ignition order between the master local blast control unit 13M and the input of the microcontroller 15 of the slave local blast control units 13S.

This compensation value therefore makes it possible to take into account in the blasting pattern the delay in the reception of the ignition order by each slave local blast control unit 13S, due to its transmission via the master local blast control unit 13M.

The ignition system described previously therefore allows the synchronized ignition of a very significant number of electronic detonators, for example greater than 4,000, according to an overall blasting pattern.

Thus, the ignition system described previously acts as if only a single local blast control unit 13 exists capable of driving in a synchronized manner all of the electronic detonators 11.

By way of non-limitative example, the precision of synchronization of the different local blast control units 13 is less than a hundred microseconds approximately.

Of course, in order to ensure safety during the ignition of the set of electronic detonators 11 according to the overall blasting pattern, the synchronization process is verified by a specific test before its use.

The synchronization test is managed by the remote blast control unit 20.

In practice, this synchronization test firstly consists of controlling each of the slave local blast control units 13S so that they are placed in an ignition signal detection mode.

The remote blast control unit 20 then sends an order to the master local blast control unit 13M for ignition of the electronic synchronization modules 14 of the slave local blast control units 13S.

Then, the remote blast control unit 20 requests each slave local blast control unit 13S to confirm detection of the ignition pulse at the input of each microcontroller 15 linked to the output of the electronic synchronization module 14 of each master local blast control unit 13S.

It is important during this synchronization test to authorize the ignition of the electronic synchronization modules 14 only and not of the electronic detonators 11 linked to the blasting line 12, itself connected to the master local blast control unit 13M.

In practice, a verification step makes it possible to ensure, by measuring the voltage existing at the terminals of each blasting capacitor CBLAST of each electronic detonator 11, that only the blasting capacitors CBLAST of the electronic synchronization modules 14 are loaded.

It will be noted that the procedures of synchronization, verification and installation of the blasting pattern at each local blast control unit 13 are carried out in standard fashion by driving in radio mode from the remote blast control unit 20.

Once all the local blast control units 13 have been verified and are ready for the ignition step, the slave local blast control units 13S are placed in a stand-by state for an ignition order originating from their electronic synchronization module 14 while the master local blast control unit 13M receives the blasting order via a radio link with the remote blast control unit 20.

As the electronic synchronization modules 14 are installed on the same communication bus as the electronic detonators 11, any interference capable of affecting the synchronization at the time of ignition is detected during the communication and test phases of the electronic detonators 11, utilized in standard fashion before the ignition step of such a system.

Moreover, the blasting order originating from the remote blast control unit 20 controlling both the electronic detonators 11 of the blasting line linked to the master local blast control unit 13M and the electronic synchronization modules 14 of the slave local blast control units 13S, there is little risk of ignition of the electronic detonators 11 of the blasting line 12 associated with the master local blast control unit 13M without triggering the ignition of the electronic detonators 11 associated with the slave local blast control units 13S.

The invention claimed is:

1. An ignition system for several sets of electronic detonators, the ignition system comprising:

for each set of electronic detonators, a blasting line connected to a local blast control unit, each set of electronic detonators being connected to a respective one of the blasting lines, wherein one of the local blast control units acts as a master local blast control unit, and at least one of said local blast control units comprises an electronic synchronization module connected to one of the blasting lines linking one set of the sets of electronic detonators to the master local blast control unit.

2. The ignition system according to claim 1, wherein at least some of the local blast control units respectively comprise an electronic synchronization module connected to the blasting line of said master local blast control unit.

3. The ignition system according to claim 2, wherein said electronic synchronization module is connected to an input of a microcontroller of said at least one of the local blast control units, ignition of said electronic synchronization module driving an ignition order via said microcontroller of a set of electronic detonators connected to the blasting line linked to said at least one of the local blast control units.

4. The ignition system according to claim 3, wherein the electronic synchronization module comprises an electronic ignition module configured to generate an electrical pulse at the input of said microcontroller.

5. The ignition system according to claim 2, wherein the local blast control units are connected by radio to a remote blast control unit.

6. The ignition system according to claim 2, wherein said electronic detonators comprise programmable ignition delay storage means, the ignition delays of the electronic detonators of said several sets of electronic detonators being programmed according to an overall blasting pattern.

7. The ignition system according to claim 1, wherein said electronic synchronization module is connected to an input of a microcontroller of said at least one of the local blast control units, ignition of said electronic synchronization module driving an ignition order via said microcontroller of a set of electronic detonators connected to the blasting line linked to said at least one of the local blast control units.

8. The ignition system according to claim 7, wherein the electronic synchronization module comprises an electronic ignition module configured to generate an electrical pulse at the input of said microcontroller.

9. The ignition system according to claim 7, wherein the local blast control units are connected by radio to a remote blast control unit.

10. The ignition system according to claim 7, wherein said electronic detonators comprise programmable ignition delay storage means, the ignition delays of the electronic detonators of said several sets of electronic detonators being programmed according to an overall blasting pattern.

11. The ignition system according to claim 1, wherein the local blast control units are connected by radio to a remote blast control unit.

12. The ignition system according to claim 1, wherein said electronic detonators comprise programmable ignition delay storage means, the ignition delays of the electronic detonators of said several sets of electronic detonators being programmed according to an overall blasting pattern.

13. The ignition system according to claim 12, wherein the programmed ignition delay for the electronic detonators connected to the blasting line linked to said master local blast control unit is incremented by a compensation value equal to a propagation time of the ignition order between said master local blast control unit and an input of a microcontroller of said at least one local blast control unit.

14. An ignition system for several sets of electronic detonators, the ignition system comprising:

for each set of electronic detonators, a blasting line connected to a local blast control unit, each set of electronic detonators being connected to a respective one of the blasting lines, wherein one of the local blast control units acts as a master local blast control unit, and at least one of said local blast control units comprises an electronic synchronization module connected to one of the blasting lines linking one set of the sets of electronic detonators to the master local blast control unit, the master local blast control unit controlling ignition of the set of electronic detonators that is connected to the one blasting line and of the electronic synchronization module connected to the one blasting line.

* * * * *